United States Patent [19]

Kortenski et al.

[11] Patent Number: 4,471,640

[45] Date of Patent: Sep. 18, 1984

[54] MACHINE FOR THE EXPLOSIVE FORMING OF A WORKPIECE OF SHEET MATERIAL

[75] Inventors: Hristo G. Kortenski; Stefan B. Vodenicharov, both of Sofia, Bulgaria

[73] Assignee: Institute po Metaloznanie i Technologia na Metalite, Sofia, Bulgaria

[21] Appl. No.: 396,765

[22] Filed: Jul. 9, 1982

[30] Foreign Application Priority Data

Jul. 15, 1981 [BG] Bulgaria ..... 52942

[51] Int. Cl.[3] ..... B21D 22/00

[52] U.S. Cl. ..... 72/56; 29/421 E

[58] Field of Search ..... 72/56; 29/421 E

[56] References Cited

U.S. PATENT DOCUMENTS 2,140,214 12/1938 Temple .
3,289,447 12/1966 Amini ..... 72/56
3,376,723 4/1968 Chelmiaski ..... 72/56

FOREIGN PATENT DOCUMENTS 29312 11/1980 Bulgaria .
2645348 4/1978 Fed. Rep. of Germany .
114012 11/1976 German Democratic Rep. .

*Primary Examiner*—Leon Gilden
*Attorney, Agent, or Firm*—Karl F. Ross

[57] ABSTRACT

A machine for the explosive forming of a workpiece of sheet material comprises a yoke-shaped frame with a base carrying a pressure cylinder whose piston is insertable from below into any of several cutouts in an overlying turntable in which dies with cavities spanned by respective workpieces are receivable. An overhanging arm of the frame supports a plate with a bottom recess confronting the cavity of an aligned die and has an upwardly extending supply channel closable by a sliding gate. In operation, with a workpiece clamped between the die and the plate, a force-transmitting medium is admitted into the recess and, with the sliding gate open, a charge provided with a detonation retarder is introduced through the channel with the aid of an igniter at the lower end of that piston which initiates its detonation, occurring after the piston has been withdrawn from the channel and the gate has been closed.

4 Claims, 2 Drawing Figures

MACHINE FOR THE EXPLOSIVE FORMING OF A WORKPIECE OF SHEET MATERIAL

FIELD OF THE INVENTION

Our present invention relates to a machine for the forming of a workpiece of sheet material with the aid of an explosive charge.

BACKGROUND OF THE INVENTION

A machine of this type is known, for example, from East German Pat. No. 114,012 according to which wet sand is deposited as an energy-transfer medium on a workpiece to be formed, leaving a cavity into which the explosive charge is manually introduced; the workpiece is then clamped between a lower and an upper die whereupon the charge is detonated. Disadvantages of this arrangement are the need for manual operation and the requirement for safety precautions to protect the operator, as well as the discontinuity of the procedure.

Bulgarian authors' certificate No. 29,312, issued to us jointly with several others, discloses a device for the forming of profiled bars with the aid of an explosive charge. Blanks to be formed into such bars are placed, two at a time, in respective dies on a base and are each clamped in position by a pressure plate with the aid of a power cylinder whose piston has a bore for the electrical detonation of an explosive charge by way of a hole in the plate aligned with that bore; an energy-transfer medium is introduced from below through a channel in the die. This device operates only with partial automation, requires considerable intervening time between forming operations and consumes much energy.

OBJECT OF THE INVENTION

The object of our present invention is to provide a machine for the purpose set forth which has a fully automated operating cycle and avoids potential hazards to the personnel.

SUMMARY OF THE INVENTION

We realize this object, in accordance with our present invention, by providing a die having a cavity which conforms to a shape to be imparted to a workpiece, a coacting member having a recess confronting that cavity and further having a channel extending from this recess to an entrance end, gating means on the coacting member for selectively blocking and unblocking the channel between the recess and the entrance end, thrust means engaging the die for pressing same against the coacting member while a workpiece spanning the cavity is clamped therebetween, a source of force-transmitting or energy-transfer medium communicating with the recess for supplying same with that medium, a magazine for the storage of explosive charges with delayed-action detonators designed to be successively aligned with the aforementioned entrance end, feeding means in line with the entrance end and operable for inserting an aligned charge into the recess by driving same through the channel past the gating means in an unblocking position thereof, and igniter means on the feeding means operable at the end of an insertion stroke for activating the detonator of the inserted charge whose delay is sufficient to enable a withdrawal of the feeding means and a blocking of the channel by the gating means prior to explosion of the charge.

BRIEF DESCRIPTION OF THE DRAWING

The above and other features of our invention will now be described in detail with reference to the accompanying drawing in which.

SPECIFIC DESCRIPTION

Figure 1:
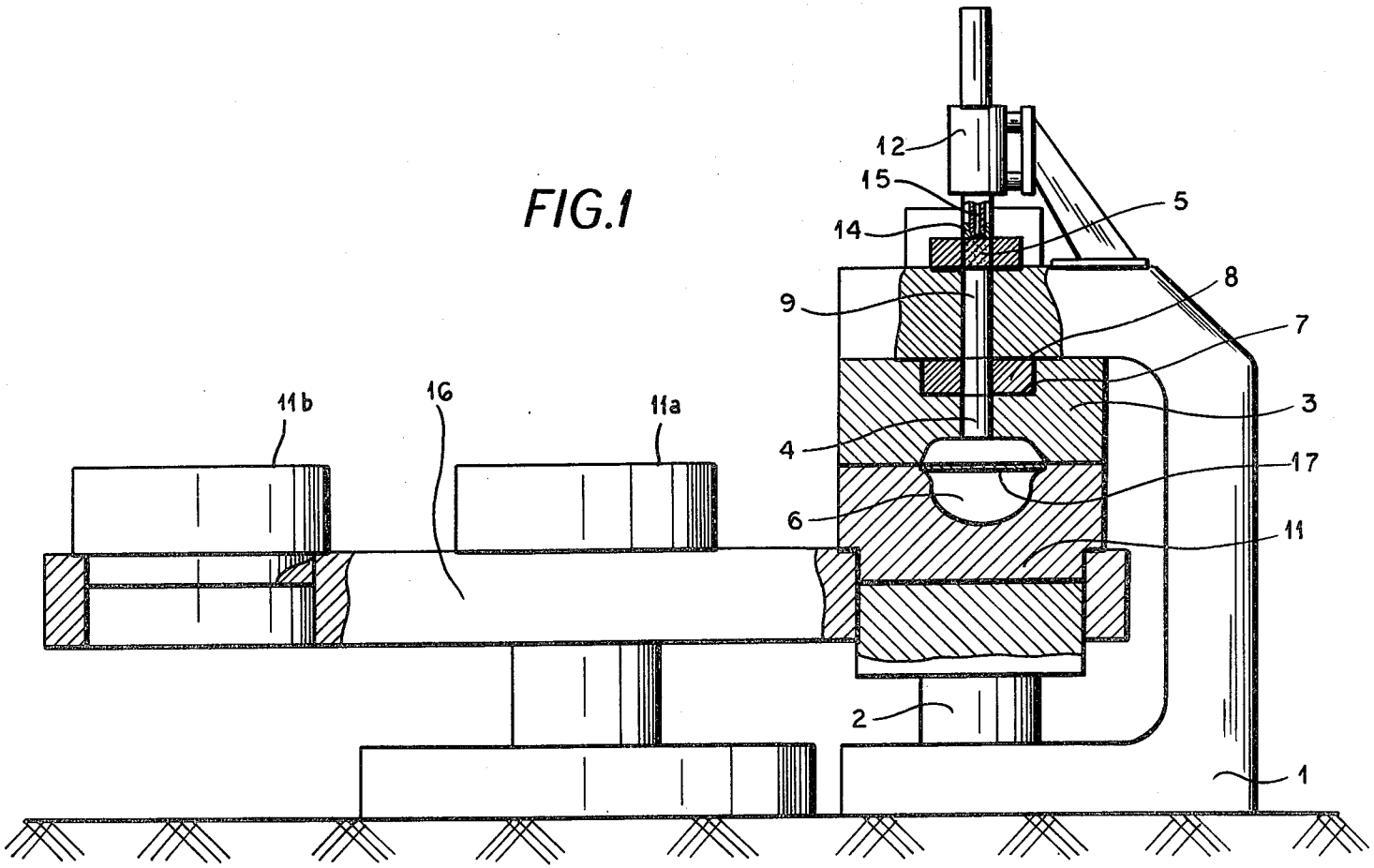
FIG. 1 is a side-elevational view, partly in section, of a machine embodying our invention.
Figure 2:
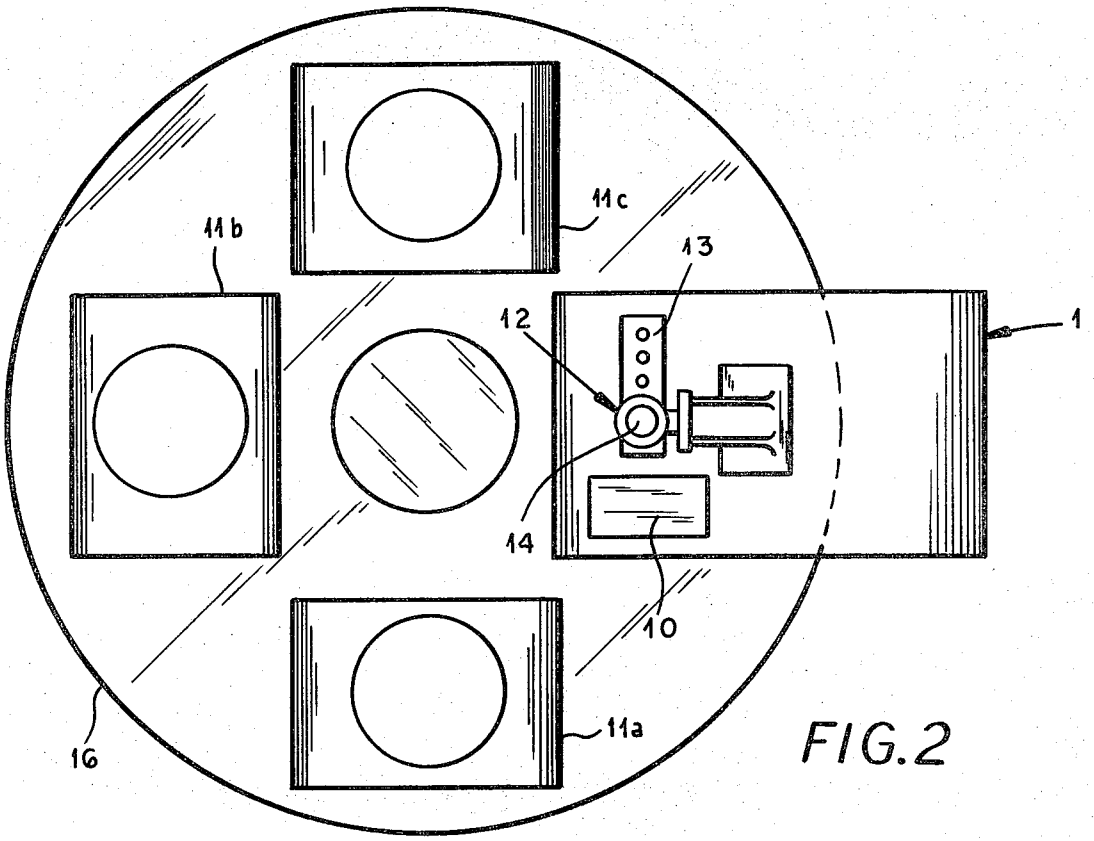
FIG. 2 is a top view of the machine shown in FIG. 1.

The machine shown in the drawing comprises a yoke-shaped frame 1 with a base supporting a pressure cylinder 2, serving as a thrust means, and an overhanging arm carrying a plate-shaped member 3 which has a bottom recess communicating with a vertical bore 4 of plate 3. The upper surface of plate 3 is formed with a rectangular seat 7 in which a flat gating valve 8 is horizontally slidable in order to interrupt the connection between bore 4 of plate 3 and a bore 9 aligned therewith in the overhanging arm of frame 1, the two bores jointly defining a channel for the introduction of an explosive charge 5. This channel also serves for the admission of force-transmitting medium from a reservoir 10, disposed atop frame 1, into the bottom recess of plate 3 when a workpiece blank 17 is clamped between that plate and a die 11 provided with a cavity 6 conforming to the shape to be imparted to that blank.

Die 11 and three similar dies 11*a*, 11*b*, 11*c* are seated in respective cutouts of a turntable 16 at locations spaced 90° apart. When one of these dies is aligned with frame 1, as particularly illustrated for die 11, pressure cylinder 2 is actuated to enter the cutout, raise the die toward the coacting plate member 3 and clamp the blank 17 is position therebetween. With gating valve 8 positioned to unblock the channel 4, 9, force-transmitting medium from reservoir 10 and an explosive charge 5 are fed from above into the space overlying the blank 17; the charge 5 is one of several such charges stored in a magazine 13 which can be successively aligned with bore 9 underneath a feeding device comprising a cylinder 12 and a piston 14. The piston carries at its lower end an igniter 15 serving for the activation of a detonator of the inserted charge 5. The detonator responds to the igniter with a delay sufficient for an upward withdrawal of piston 14 and a closure of channel 4, 9 by gating valve 8 before the charge explodes.

After the forming operation, the turntable 16 transports the finished workpiece 17 into a position where it can be removed from the die which thereafter can be cleaned, even as blanks in the other dies undergo similar operations.

We claim:

1. A machine for the explosive forming of a workpiece of sheet material, comprising:

a die provided with a cavity conforming to a shape to be imparted to a workpiece;

a coacting member having a recess confronting said cavity and further having a channel extending from said recess to an entrance end;

gating means on said member for selectively blocking and unblocking said channel between said recess and said entrance end;

thrust means engaging said die for pressing same against said member with a workpiece spanning said cavity clamped therebetween;

a source of force-transmitting medium communicating with said recess for supplying same with a quantity of said medium;

a magazine for the storage of explosive charges with delayed-action detonators successively alignable with said entrance end;

feeding means in line with said entrance end and operable for inserting an aligned charge into said recess by driving same through said channel past said gating means in an unblocking position thereof; and igniter means on said feeding means operable at the end of an insertion stroke for activating the detonator of the inserted charge whose delay is sufficient to enable a withdrawal of said feeding means and a blocking of said channel by said gating means prior to explosion of the charge.

2. A machine as defined in claim 1, further comprising a frame with a base and an overhanging arm, said base supporting said die through the intermediary of said thrust means with said cavity facing upward, said member being a plate supported above said die by said arm, said channel including two aligned bores in said plate and in said arm with said gating means interposed therebetween, said magazine being disposed on said arm, said feeding means being a piston received in a cylinder above said arm.

3. A machine as defined in claim 2 wherein said gating means comprises a slide valve movable in a recess on an upper surface of said plate adjoining the underside of said arm.

4. A machine as defined in claim 2, further comprising a turntable with a peripheral zone provided with a plurality of cutouts selectively alignable with said thrust means, said die being one of several dies respectively seated in said cutouts.

* * * * *